US006350101B1

(12) United States Patent
Fertig et al.

(10) Patent No.: US 6,350,101 B1
(45) Date of Patent: Feb. 26, 2002

(54) BARREL PUMP

(75) Inventors: Volker Fertig, Wertheim; Thomas Sigel, Kreuzwertheim, both of (DE)

(73) Assignee: Lutz-Pumpen GmbH & Co. KG, Wertheim (DE)

( * ) Notice: Subject to any disclaimer, the term of this patent is extended or adjusted under 35 U.S.C. 154(b) by 0 days.

(21) Appl. No.: 09/638,316

(22) Filed: Aug. 14, 2000

(30) Foreign Application Priority Data

Aug. 16, 1999 (DE) ..... 199 38 760

(51) Int. Cl.[7] ..... F01D 5/02
(52) U.S. Cl. ..... 415/131; 415/156; 415/157
(58) Field of Search ..... 415/128, 131, 415/132, 156, 157

(56) References Cited

U.S. PATENT DOCUMENTS 1,682,966 A * 9/1928 Hoppes ..... 415/131
4,244,685 A * 1/1981 Lahtinen ..... 431/265
4,818,177 A * 4/1989 Grohmann ..... 415/49
4,909,704 A * 3/1990 Lutz ..... 415/157

FOREIGN PATENT DOCUMENTS

DE 37 18 325 10/1988
DE 196 30 347 7/1997

* cited by examiner

*Primary Examiner*—Edward K. Look
*Assistant Examiner*—Ninh Nguyen
(74) *Attorney, Agent, or Firm*—Reed Smith LLP

(57) ABSTRACT

The barrel pump has a tubular pump housing and a rotor shaft which is supported by a support tube and, at its bottom end, bears an elastic cone which has a circumferential groove which interacts with the opening edge of an inlet in the manner of a snap-action closure when the rotor shaft is displaced in the direction of incoming flow with respect to the pump housing. The cone seal is situated in front of the inlet, as seen in the direction of flow. To displace the rotor shaft with respect to the pump housing, a rotary cap is provided above the outlet, pins of which cap engage in grooves of a groove flange which is screwed onto the pump housing, the grooves having a pitch, so that as a result of the rotary cap being turned relative displacement between rotor shaft and pump housing is brought about.

3 Claims, 2 Drawing Sheets

BARREL PUMP

BACKGROUND OF THE INVENTION a) Field of the Invention

The invention relates to a barrel pump with a pump rotor which is driven by a motor via a rotor shaft and which is used to pump the liquid upward, in a ring channel of a tubular pump housing, through an inlet opening situated at the bottom end thereof, to an outlet arranged at the top end of the ring channel, the inlet opening being closable by means of a closure body which can be actuated by a relative displacement between rotor shaft and pump housing, and the closure body being designed as a cone seal and, in the open position, being arranged at the bottom end of the pump housing in front of the central inlet opening.

b) Description of the Related Art

A barrel pump of this type is known from DE-A-196 30 347. In this known barrel pump, although the cone seal is situated in front of the inlet opening, it is still inside the pump housing, which is necessary in order for the cone seal to be pressed against the edge of the inlet opening by means of a spring. The cone seal is transferred into the open position by displacement of the rotor shaft, and in the open state the rotor shaft presses continuously against the cone seal, resulting in a relative movement between cone seal and rotor shaft. At the extremely high rotational speeds of the rotor shaft, this leads to rapid wear to the cone seal unless special measures for supporting the rotor shaft are provided in the support region, and such measures increase the structural outlay still further, in addition to the pressure spring which is required. Since the cone seal together with the pressure spring which is required to execute the closure movement has to be arranged inside the pump housing, there is a relatively great distance between the pump rotor and the bottom end of the pump housing.

OBJECT AND SUMMARY OF THE INVENTION

The primary object of the invention is to design a barrel pump of the generic type in such a way that, while achieving a good level of efficiency in terms of emptying the residues, it requires a lower structural outlay and, in addition, is suitable for all materials used in the pump construction sector.

In a barrel pump of the type explained in the introduction, this object is achieved, according to the invention, by the fact that the cone seal is arranged at the end of the rotor shaft, in such a manner that it can rotate freely thereon and in a form-fitting manner, with a slight axial play, in the axial direction, and can be pulled into the closed position by the relative displacement between rotor shaft and pump housing, and that the cone seal is of elastic design and has a circumferential groove which, in the closed position, can be latched to the edge of the inlet opening.

Since, in this embodiment, only the cone seal has to be designed as an elastic part, and therefore has to consist of a different material from the other parts of the pump, when selecting said material it should be ensured that it is able to withstand the media which are to be conveyed. There are plastics materials, for example ETFE, which are able to withstand most liquids which can be conveyed by pumps which have been introduced onto the market to date. Since, given a suitable selection of materials, the cone seal can be used for all pumps made from different materials, the need to change the design in the event of material changes, which has been established in the known pump, no longer occurs.

It is therefore possible with this design according to the invention, starting from a standard barrel pump, by using a longer rotor shaft which projects out of the inlet and by providing a cone seal which is designed in accordance with the invention, if appropriate in combination with a pump base which can be replaced and is usually screwed on, to convert this standard barrel pump into a so-called residue-emptying pump, in which virtually the entire content of a barrel is emptied and it is possible to prevent medium which is to be conveyed and is situated in the pump from running back into the barrel. The requirements which are to be imposed on the pump base are that this base should have an opening edge which is able to form a snap-action closure with the cone seal and, moreover, must ensure protection for the cone seal which is situated in front of the inlet opening. The pump according to the invention has the advantage that the pump rotor can be arranged very closely behind the inlet opening, since the cone seal or the closure body is situated outside the inlet opening, specifically in a space which must in any case be provided in order for the liquid situated in the barrel to be sucked up. Therefore, by arranging the cone seal in front of the inlet opening, the distance between the pump rotor and the inlet opening is reduced to a minimum without the sealing body requiring the distance from the bottom of the barrel to the pump rotor to be increased, since a certain distance between the bottom of the barrel and the inlet opening has to be present in order to ensure that the liquid flows into the inlet. This distance is sufficient to allow the cone seal to be arranged in front of the inlet opening. Due to the elasticity of the cone seal, it latches to the opening edge of the inlet in the manner of a snap-action closure. There is no need for any restoring springs for actuating the closure body, which is designed as a cone seal, and this fact simplifies the structure of the pump. Since the closure body arranged on the rotor shaft is moved into its closed position and its open position by relative displacement between the rotor shaft and the pump housing, additional components for actuating this closure body are not required. This makes the pump of extremely simple structure.

Working on the basis of a barrel pump having a connection head which has the upper rolling-contact bearings, which are designed as fixed bearings, for the rotor shaft and a coupling for a drive motor and which can be connected to the tubular pump housing by means of a screw connection, in a further advantageous configuration of the invention an adjustment ring, which serves as an adjustable stop for the connection head, is screwed onto the external screw thread of the tubular pump housing or of an extension. In this way, it is possible, in a simple manner, to compensate for dimensional changes caused by thermal expansion, so that reliable operation is always possible.

The extension preferably comprises a rotary cap and a groove flange, which together form an adjustment device for displacement of the rotor shaft.

The invention is explained in more detail below with reference to an exemplary embodiment which is illustrated in the drawings.

DESCRIPTION OF THE PREFERRED EMBODIMENTS

Figure 1:
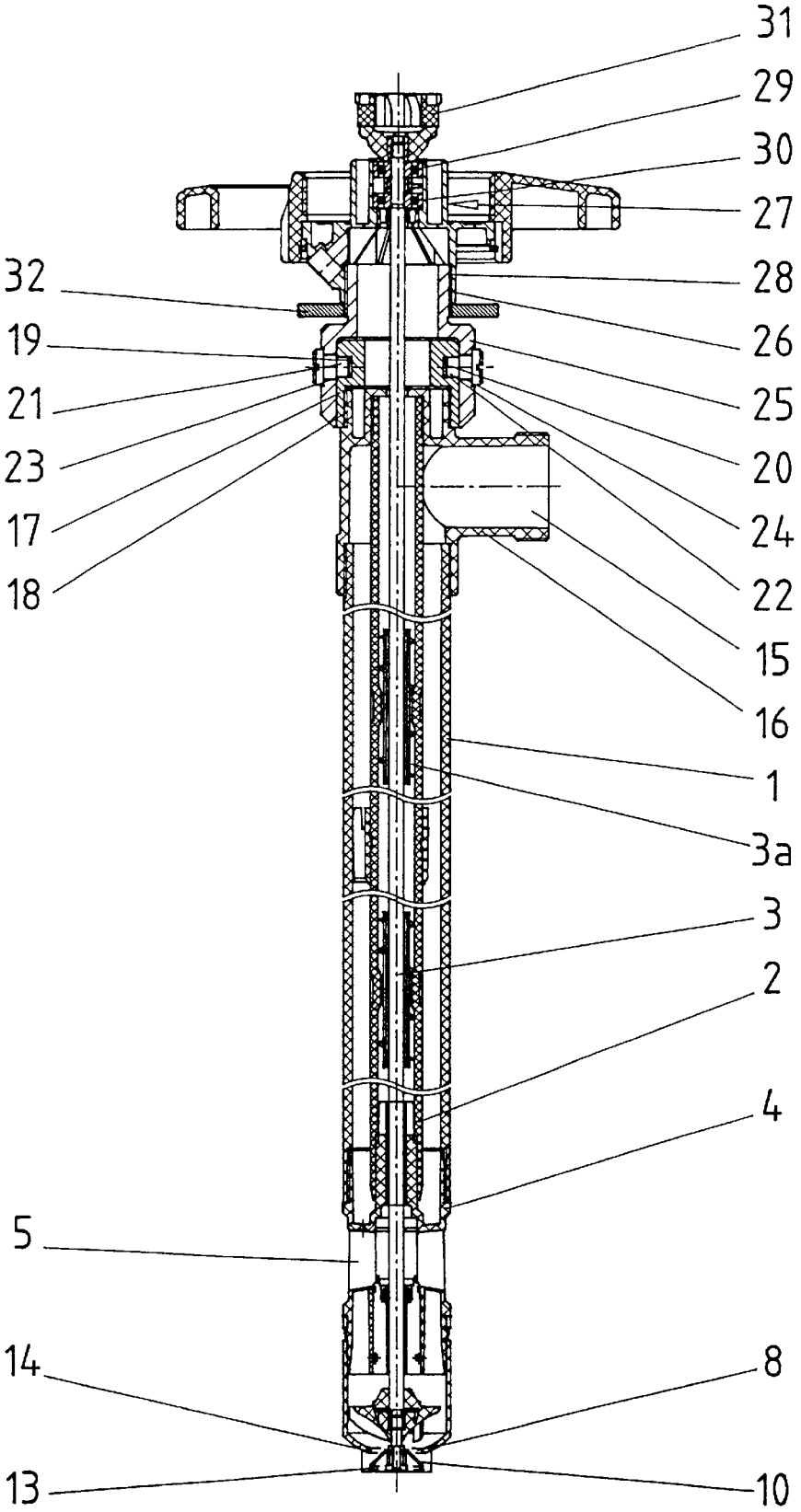
FIG. 1 shows a longitudinal section through a barrel pump.
Figure 2:
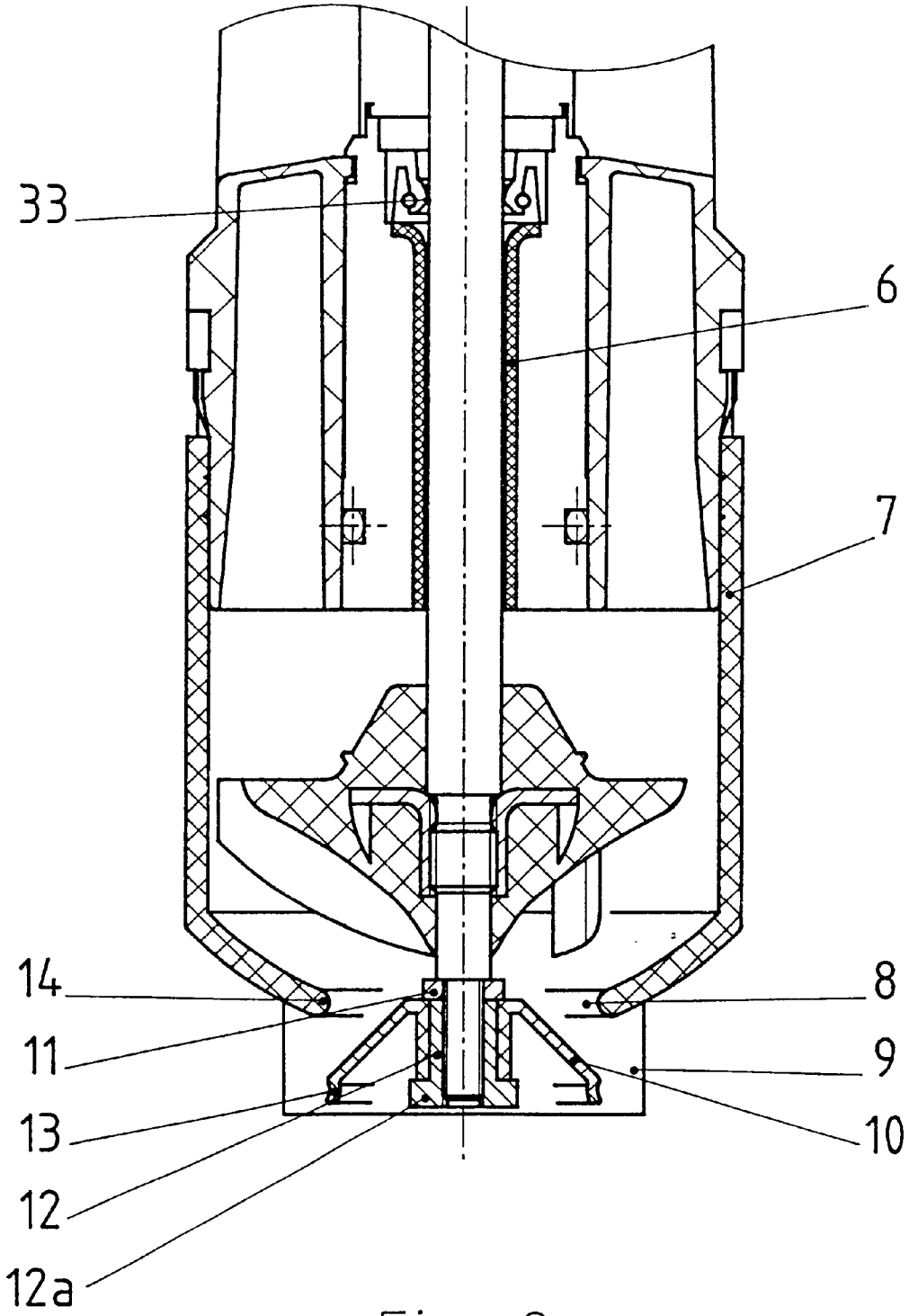
FIG. 2 shows a section through the pump base, on an enlarged scale.

The barrel pump illustrated has a tubular pump housing 1, in the interior of which a support tube 2 is provided in order to support a rotor shaft 3, the rotor shaft 3 being supported by a sliding-contact bearing 3*a*, which is in the form of a flexible tube, in the support tube 2. At the bottom end of the pump housing 1, there is a device 4 with a leak channel 5 which connects the interior of the support tube to the pump surroundings and is therefore able to remove rising liquid which, despite the presence of a sealing gap 6, rises up along the rotor shaft 3. A shaft sealing ring 33 prevents the liquid from flowing in the opposite direction. Furthermore, a pump base 7 with an inlet which has an inlet opening 8 and through which the rotor shaft 3 projects outward is provided. Support feet 9 which prevent the pump base 7 with the inlet opening 8 from resting directly on the bottom of a barrel are provided at the pump base 7. At that end of the rotor shaft 3 which projects out of the inlet opening 8, there is a closure body in the form of a cone seal 10, which the rotor shaft passes through in a sealed manner. The cone seal 10 can be displaced to a small extent in the axial direction, this small displacement travel being delimited by a top stop disk 11 and a sleeve 12 with stop 12*a* which can be screwed onto the bottom end of the rotor shaft. The cone seal 10 is mounted on the sleeve 12 in such a manner that it can rotate freely. This cone seal 10 has a circumferential groove 13 which can be latched to the edge 14 of the inlet opening 8. Since the cone seal 10 consists of an elastic material, it can be used to close off the inlet opening 8 by means of a snap action when the cone seal 10 is pulled into the inlet opening 8 as a result of a displacement of the rotor shaft 3 with respect to the pump housing 1. For the opening operation, the rotor shaft is pressed slightly further outward again, in order to release the latching connection between the cone seal 10 and opening edge 14 again.

To displace the rotor shaft 3 with respect to the pump housing 1 in both directions, a groove flange 17 is screwed onto an external screw thread 18 of a T-piece 16, which has an outlet 15, above the T-piece 16 and pins 21, 22, which can be screwed, in each case by means of a threaded piece 23, 24, into a corresponding threaded hole in a rotary cap 25, engage in grooves 19, 20, which are provided with a pitch, in this groove flange 17. At its top end, the rotary cap 25 has an external screw thread 26, onto which a connection head 27 can be screwed. The T-piece 16, the grooved flange 17 and the rotary cap 25 form a tubular extension of the tubular pump housing 1 and are therefore to be considered part of the latter. In a barrel pump without an adjustment device for the relative displacement between the rotor shaft and pump housing, this connection head 27 is screwed directly onto the external screw thread 18 of the T-piece 16, by means of its internal screw thread 28. The connection head 27 has two rolling-contact bearings 29 and 30 which form a fixed bearing for the rotor shaft. Furthermore, a coupling 31 is provided for connection to a drive motor, which is not shown. An adjustment ring 32, which serves as an adjustable stop for the connection head, is screwed onto the external screw thread 26 of the rotary cap 25, which in practice forms an extension of the pump housing. With the aid of this adjustment ring 32, it is possible to bring about a slight relative displacement between rotor shaft and pump housing and therefore to compensate for thermal expansion tolerances and manufacturing tolerances. The actual relative displacement between rotor shaft 3 and pump housing 1, which serves to move the cone seal 10 from the open position into the closed position and vice versa, is effected by rotation of the rotary cap 25 via the pins 21 and 22 which engage in the thread-like grooves 19 and 20. Depending on the direction of rotation, the connection head 27 is raised or lowered with respect to the pump housing 1, thus displacing the rotor shaft 3 to the extent that, in one limit position, this shaft projects so far out of the inlet opening 8 that the cone seal 10 opens the inlet opening 8. In the other limit position, the circumferential groove 13 in the cone seal 10 interacts with the edge 14 of the inlet opening 8, with the result that the pump base and therefore the barrel pump are closed off. Due to its elastic design, the cone seal 10 remains in the closed position until the rotor shaft 3 is pressed back into the position illustrated in the figure.

While the foregoing description and drawings represent the preferred embodiments of the present invention, it will be obvious to one skilled in the art that various changes and modifications may be made therein without departing from the true spirit and scope of the present invention.

What is claimed is:

1. A barrel pump comprising:

a pump rotor;

a rotor shaft;

a motor for driving said pump rotor via said rotor shaft;

said pump rotor being used to pump liquid upward;

a tubular pump housing having a ring channel, said liquid being pumped in said ring channel through an inlet opening situated at the bottom end of said tubular pump housing, to an outlet arranged at the top end of the ring channel;

a closure body for making the inlet opening closable;

said closure body being actuated by relative displacement between rotor shaft and pump housing;

said closure body being designed as a cone seal and, in an open position, being arranged at a bottom end of the pump housing in front of the inlet opening;

said cone seal being arranged at an end of the rotor shaft, in such a manner that it can rotate freely thereon and in a form-fitting manner, with a slight axial play, in the axial direction, and can be pulled into the closed position by the relative displacement between rotor shaft and pump housing; and said cone seal being of elastic design and having a circumferential groove which, in the closed position, can be latched to an edge of the inlet opening.

2. The barrel pump as claimed in claim 1, having a connection head which has upper rolling-contact bearings, which are designed as fixed bearings, for the rotor shaft and a coupling for a drive motor and which can be connected to the tubular pump housing by means of a screw connection, wherein an adjustment ring, which serves as an adjustable stop for the connection head, is screwed onto the external screw thread of the tubular pump housing or of an extension.

3. The barrel pump as claimed in claim 2, wherein the extension comprises a rotary cap and a groove flange, which together form an adjustment device for displacement of the rotor shaft.

* * * * *